United States Patent [19]

Boerner

[11] Patent Number: 5,001,835

[45] Date of Patent: Mar. 26, 1991

[54] WAFFLE-STYLE CUTTER FOR CUTTING FRUIT, VEGETABLES OR THE LIKE

[75] Inventor: Alfred Boerner, Niederkail, Fed. Rep. of Germany

[73] Assignee: A. Boerner GmbH, Fed. Rep. of Germany

[21] Appl. No.: 447,067

[22] Filed: Dec. 7, 1989

[30] Foreign Application Priority Data

Jul. 26, 1989 [DE] Fed. Rep. of Germany ..... 89090683[U]

[51] Int. Cl.[5] ..... B26B 3/00; B26B 3/04; B26B 3/03

[52] U.S. Cl. ..... 30/278; 30/279.6; 30/280

[58] Field of Search ..... 30/278, 279.2, 279.4, 30/279.6, 280, 312, 314; 241/168, 273.1; 83/858, 856

[56] References Cited

U.S. PATENT DOCUMENTS

| | | | |
|---|---|---|---|
| 4,120,089 | 10/1978 | Borner | 30/278 |
| 4,281,460 | 8/1981 | Harris | 30/278 |
| 4,648,300 | 3/1987 | Hassenfelt, Jr. | 30/312 |
| 4,733,589 | 3/1988 | Wolff | 30/279.2 |
| 4,790,488 | 12/1988 | Borner | 30/279.6 |
| 4,908,944 | 3/1990 | Brothers | 30/280 |

FOREIGN PATENT DOCUMENTS

| | | | |
|---|---|---|---|
| 1273759 | 7/1968 | Fed. Rep. of Germany | 30/278 |

*Primary Examiner*—Douglas D. Watts
*Assistant Examiner*—Paul M. Heyrana, Sr.
*Attorney, Agent, or Firm*—Hill, Van Santen, Steadman & Simpson

[57] ABSTRACT

Waffle-style cutter for slicing fruit, vegetables or the like, comprising a blade-holding plate at whose front edge a wave-shaped cutter blade is arranged, comprising two frame ledges arranged essentially parallel, and comprising a slide plate adjoining the frame ledges and introduceable parallel to the blade-holding plate, whereby a narrow gap remains between the trailing edge of the slide plate and the cutter blade. In accord with the invention, a support plate fashioned as a closed surface is arranged under the slide plate.

9 Claims, 5 Drawing Sheets

WAFFLE-STYLE CUTTER FOR CUTTING FRUIT, VEGETABLES OR THE LIKE

BACKGROUND OF THE INVENTION

This invention is directed to a waffle-style cutter for slicing fruit, vegetables or the like. More particularly, the cutter includes a blade-holding plate at whose front edge a wavy cutting blade is arranged, two frame ledges arranged essentially parallel, and a slide plate that adjoins the frame ledges and can be placed parallel to the blade-holding plate, whereby a narrow gap remains between the trailing edge of the slide plate and the cutter blade.

The prior art from which the present invention proceeds is schematically shown in the drawings with reference to FIG. 1.

As shown, the known waffle-style cutter comprises two frame ledges 2 that are joined in their back part by a blade-holding plate 3 and are joined in their front part by two cross-stays 4 as well as a diagonal stay 5 arranged at the underside of the waffle-style cutter. A slide plate (not shown) arranged parallel to the blade-holding plate 3 can be placed in the front part of the waffle-style cutter. This slide plate has noses arranged at its underside engaging in front of projections 7 arranged at the level of the stays 4 and 5 or lying thereupon. For fixing the slide plate in two possible latched positions, a nose 8 is provided at the front end at at least one frame ledge 2. This nose 8 engages corresponding lateral notches in the slide plate. In the two possible latched positions of the slide plate, this is arranged such that a narrow gap, that allows the cut material to fall through, remains between the trailing edge of the slide plate and a cutter blade 9 that is secured to the leading edge of the blade-holding plate 3.

The known waffle-style cutter is disadvantageous insofar as the slide plate sags when pressed onto the material to be cut and thereby deforms over time or even breaks in an extreme case.

It is therefore the object of the invention to improve the known waffle-style cutter to such effect that a sag of the slide plate when pressed onto the material to be cut is no longer possible and, thus, to improve the functionability and useful life of the waffle-style cutter overall.

These and other objects of this invention will become apparent from the following disclosure and appended claims.

SUMMARY OF THE INVENTION

The foregoing object is inventively achieved in that a support plate fashioned as a closed surface is arranged under the slide plate. As a result thereof, the slide plate is lent considerably greater stability against sagging when pressed onto material to be cut. Over and above this, the slide plate can be more easily placed into the waffle-style cutter due to the better guidance.

In a preferred embodiment of the invention, the support plate has essentially the same shape as the slide plate. This design enables a largely full-surface support of the slide plate from below. At the same time, the support plate in this design can serve directly as cutter support for a defined slice thickness of the material to be cut, i.e., can assume the function of the slide plate.

The invention further proposes that the support plate comprises recesses for the penetration of noses arranged at appropriate locations of the underside of the slide plate in a first latched position thereof. A firm seat of the slide plate in the support plate is thereby guaranteed.

It is provided in a further embodiment of the invention that the noses at the underside of the slide plate are supported on the support plate in a second latched position of the slide plate. A further variation in the height of the cutter support is created in this way in order to vary the slice thickness of the material to be cut.

The invention proposes that the support plate has an unlocking opening for the slide plate. The slide plate can be unproblematically removed from the waffle-style cutter from below in this fashion without requiring one to place fingers in the region of the sharp cutter blade.

In the invention, finally, it is also provided that a cross-stay residing perpendicular to the underside of the support plate is arranged at the underside of the support plate, this cross-stay extending from one frame side to the other. This cross-stay is thereby fashioned wave-shaped with three or four waves in an especially preferred fashion and is arranged at a distance of 4–6 cm from the front end of the waffle-style cutter. The cross-stay fashioned in this way leads, first, to a further increase in the stability of the support plate and, second, also serves as a gripping ledge for the fingers of the hand that seizes the waffle-style cutter. The distance of the cross-stay of 4–6 cm from the front edge of the waffle-style cutter has thereby proven especially meaningful in ergonomic terms for a sure grasping of the waffle-style cutter.

Advantageously, the front end of the waffle-style cutter is fashioned as an angled profile, this, first, further improving the manipulation overall and, second, creating the possibility of latching the waffle-style cutter in, for example, an appropriate recess of a collecting dish for the cut material.

BRIEF DESCRIPTION OF THE DRAWINGS

Further features and advantages of the invention derive from the following description of an exemplary embodiment that shall be set forth in greater detail with reference to the attached drawings. Thereby shown are.

DESCRIPTION OF THE PREFERRED EMBODIMENT

Figure 1:
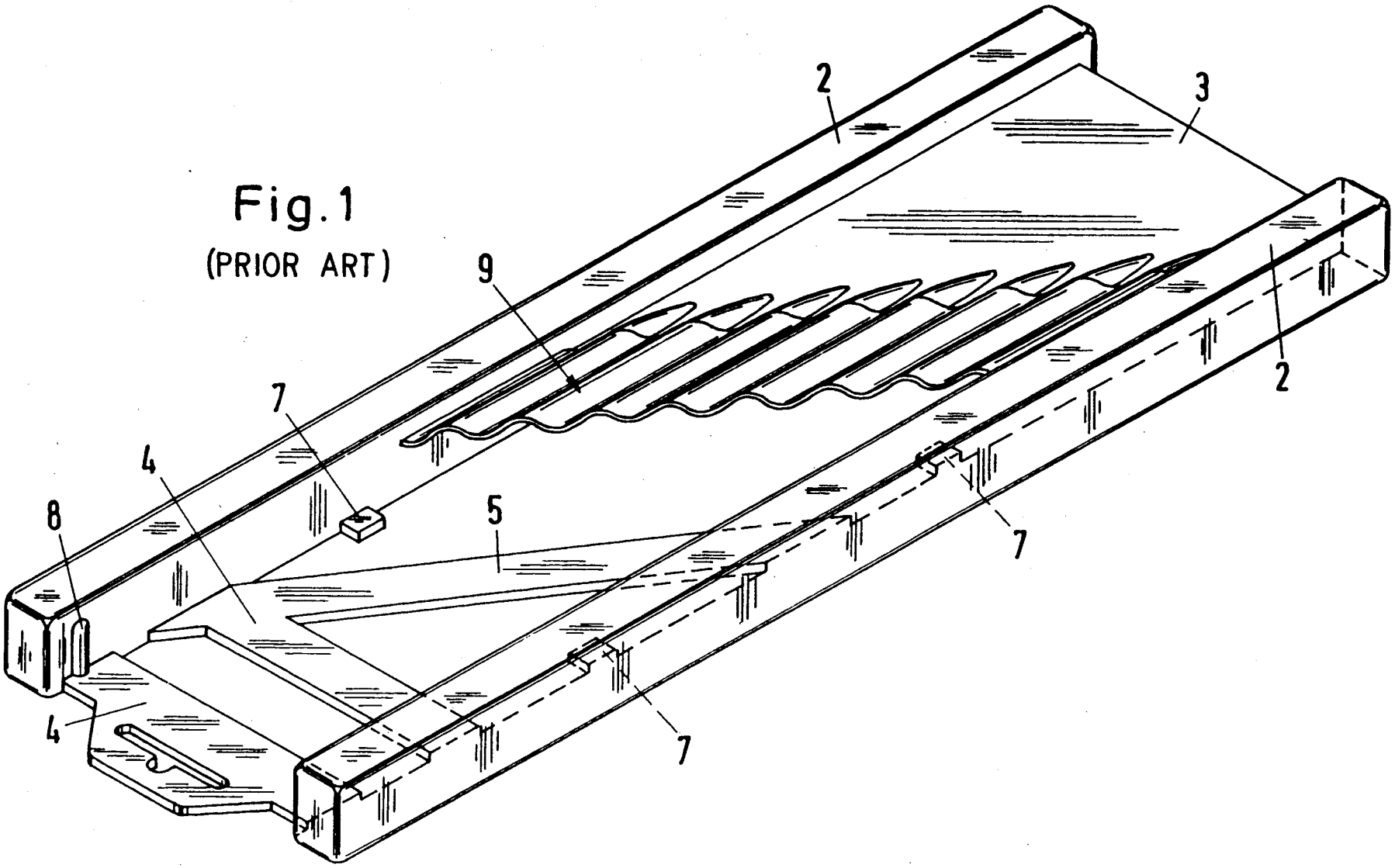
Fig. 1 (PRIOR ART)
FIG. 1 is a schematic and perspective view of a waffle-style cutter of the prior art.
Figure 2:
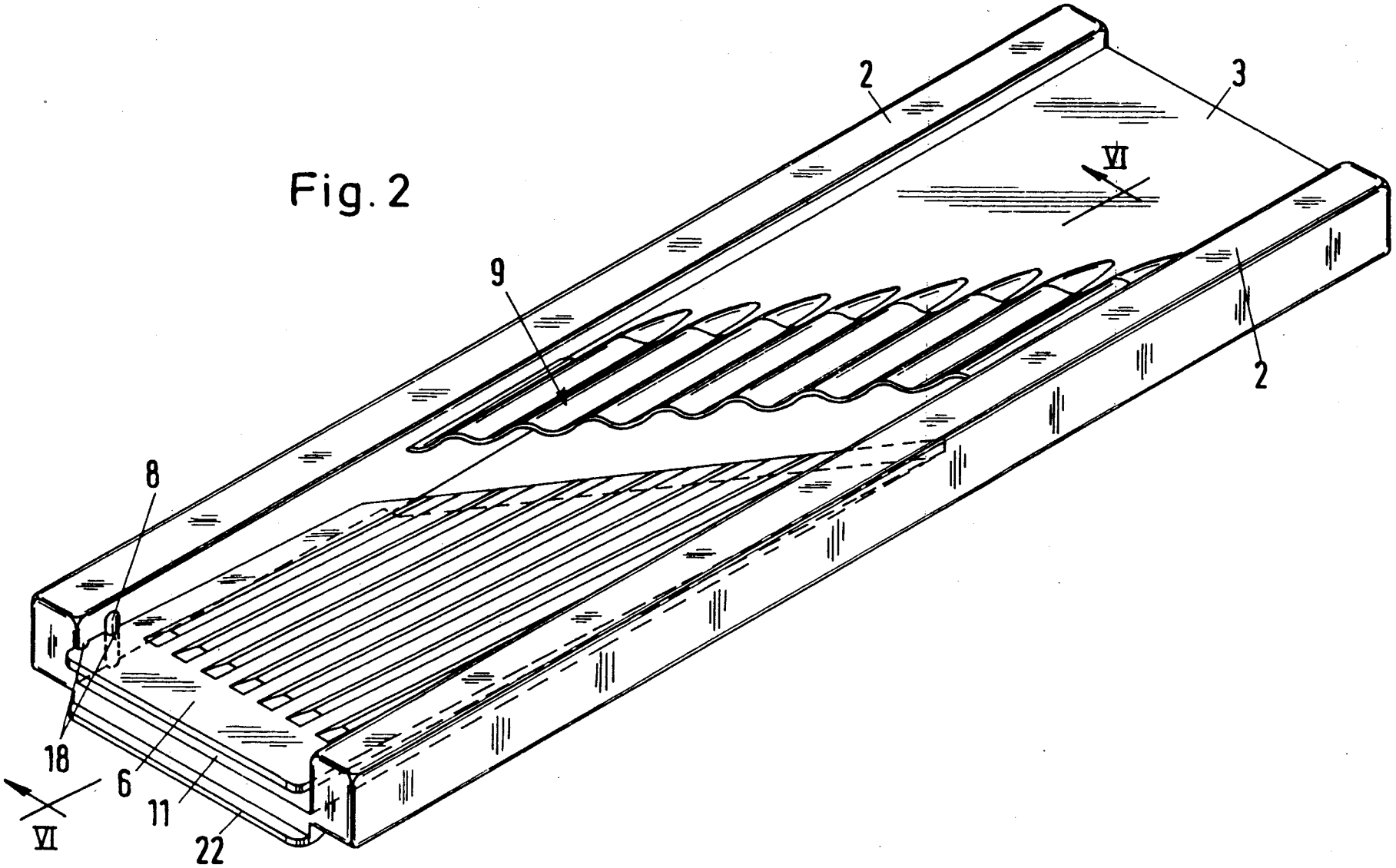
FIG. 2 is a schematic view of the waffle-style cutter of the invention with inserted slide plate in the first latched position.

The waffle-style cutter shown in the drawings essentially comprises two frame ledges 2 that are held together in their back part (at the right) in the drawing by a blade-holding plate 3 at whose diagonally proceeding front edge a wave-shaped cutter blade 9 is secured. In complementary design, the device is completed by a slide plate 6 that is arranged such that in both latched positions a narrow gap that allows the cut material to drop through remains between trailing edge of the slide plate 6 and the cutter blade 9.

Figure 3:
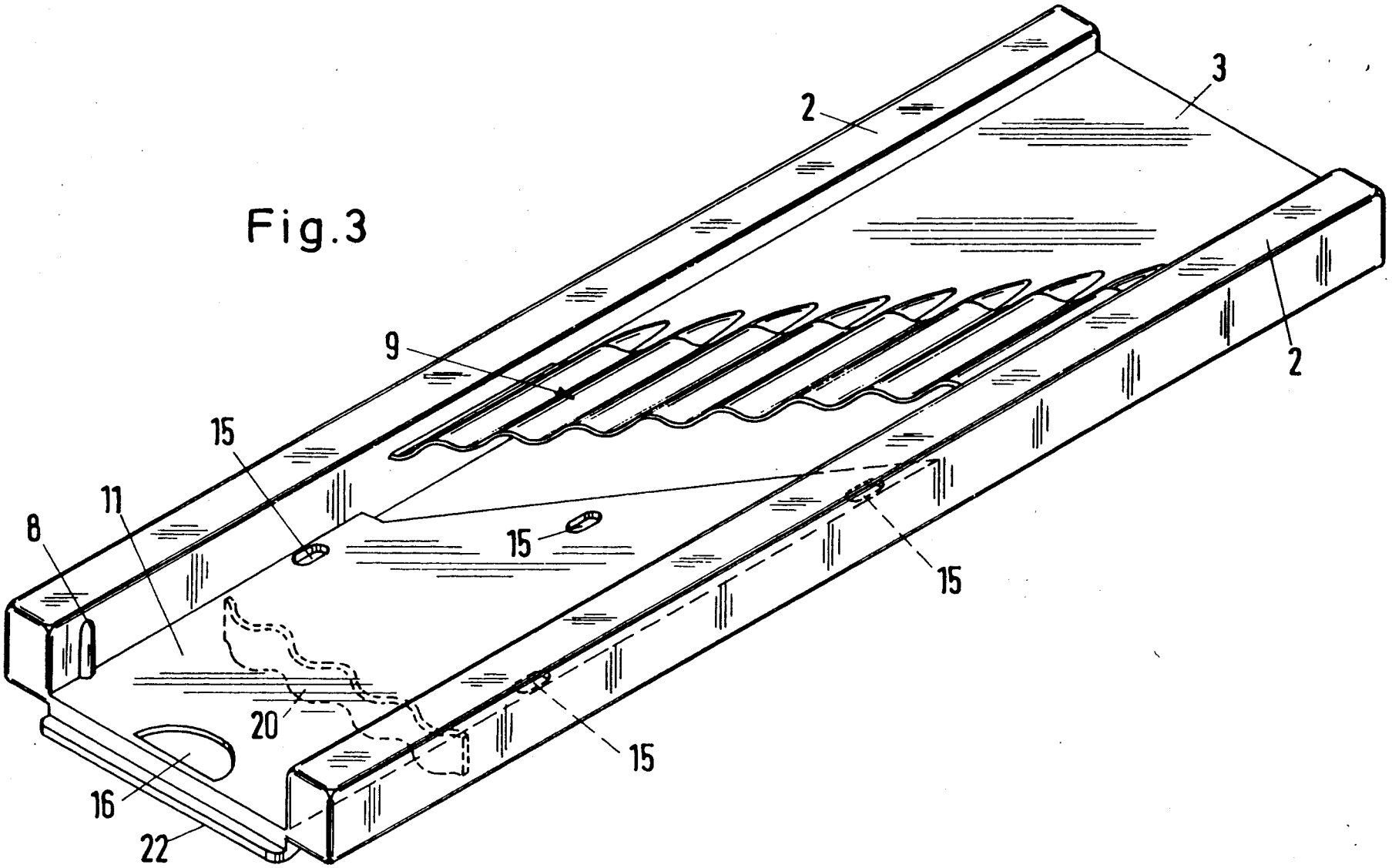
FIG. 3 is similar to FIG. 2 without slide plate.

The illustration of the waffle-style cutter of the invention in FIG. 3 particularly shows details of a support plate 11 of the invention. In shape, this essentially corresponds to the slide plate 6. Recesses 15 for the penetration of noses arranged at appropriate locations of the underside of the slide plate 6 in a first latched position thereof are provided in the back section of the support plate 11. As is likewise the case in the waffle-style cutter of the prior art, this latched position is defined by a nose 8 at at least one frame ledge 2 that is in engagement with notches 18 at at least one long side of the slide plate 6. In the present example, two latched positions are provided, whereby the noses arranged at the underside of the slide plate 6 in the first latched position thereof penetrate the recesses 15 on the support plate 11 and, in the second latched position of the slide plate, are supported on the support plate, so that the two latched positions of the slide plate 6 differ on the basis of a different height thereof for varying the slice thickness of the material to be cut.

Figure 5:
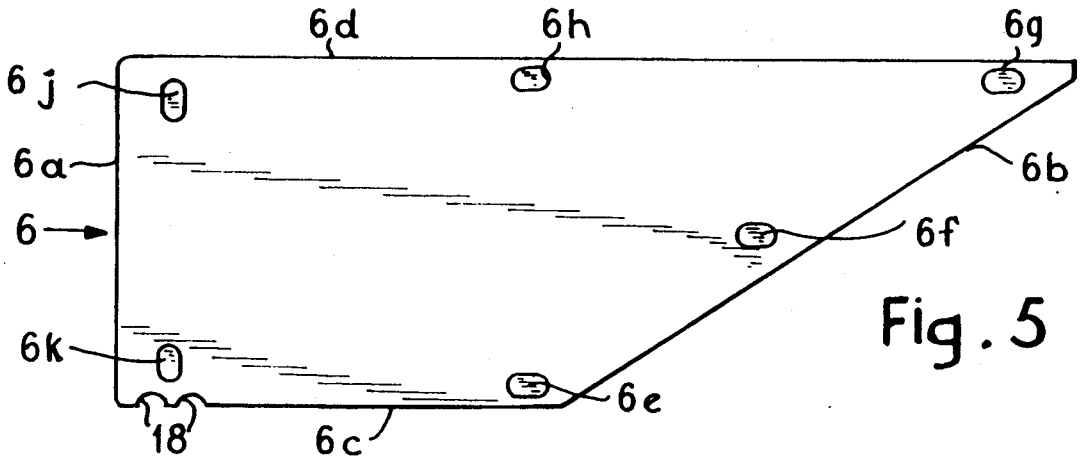
FIG. 5 is a plan view of the bottom of a slide plate.
Figure 6:
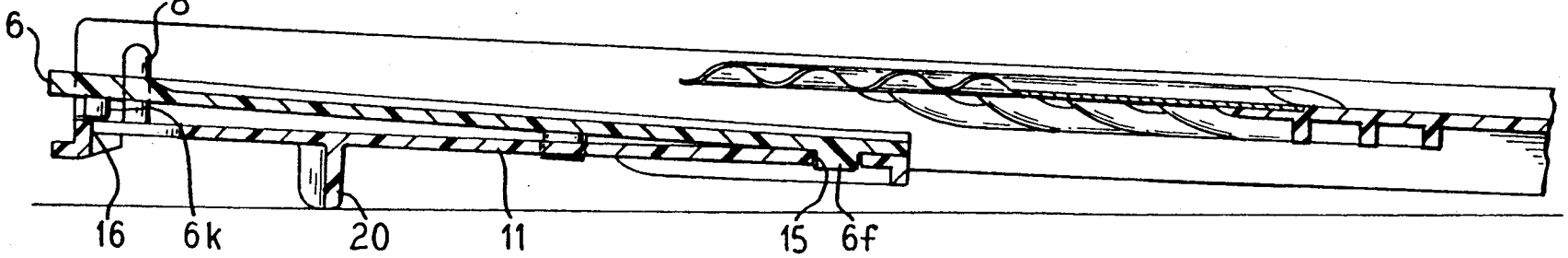
FIG. 6 is a vertical cross-sectional view taken along line 6—6 of FIG. 2 and showing the slide plate in a first latched position.
Figure 7:
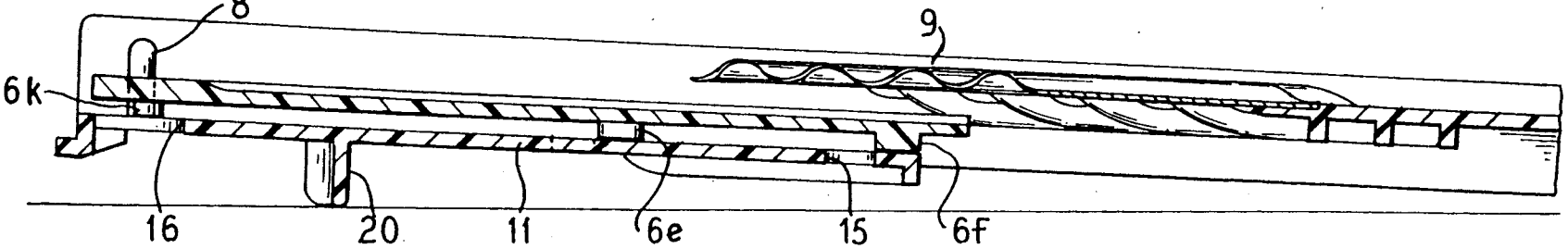
FIG. 7 is a vertical sectional view similar to FIG. 6 showing the slide plate in a second latched position.

The slide plate 6 is a trapezoid-shaped member having a front or leading edge **6*a*, back or trailing edge 6*b*, and the side edge or short edge 6*c* and the side or long edge 6*d*. The bottom surface of the slide plate (as shown in FIG. 5) includes three oblong projections or noses 6*e*, 6*f* and 6*g* along the trailing edge 6*b*. A fourth oblong projection or nose 6*h* is provided on the bottom surface along the long edge 6*d*. These noses are for cooperation with the recesses 15 in the support plate and the support plate 11** itself.

Round projections or noses **6*j* and 6*k* extend from the bottom of the slide plate and are positioned adjacent the front or leading edge 6*a* for cooperation with the support plate 11**.

The pair of notches 18 are provided along the short edge **6*c* adjacent the leading edge 6*a*. Each of these notches is for cooperation with the nose 8**.

In a first latched position, the projections **6*e*, 6*f*, 6*g* and 6*h* fit into the recesses 15, the projections 6*j* and 6*k* rest on the support plate, and the notch 18 engages the nose 8. In this position the slide plate is tilted downwardly relative to the support plate 11 and defines a first cutting space relative to the knife 9**.

The slide plate 6 can be released from this position using opening 16 and positioned relative to the slide plate where all of the projections or noses **6*e*, 6*f*, 6*g*, 6*h*, 6*j* and 6*k* engage the support plate and the notch 6*n* engages the nose 8**. In this position the slide plate is parallel to support plate and the cut is thinner than before or the vertical distance between the slide plate and knife is less than before.

In the foregoing system the notches, latches and noses can act to maintain the positioning of the slide plate relative to the knife.

In the exemplary embodiment of the waffle-style cutter of the invention according to FIG. 3, an unlocking opening 16 for the slide plate 6 is provided at the front edge of the support plate 11, this unlocking opening 16 being fashioned semicircularly and having a size that is suitable for the passage of a finger for releasing the slide plate 6 from the waffle-style cutter.

Broken lines indicate the cross-stay 20 arranged on the underside of the support plate 11, this cross-stay 20 in the illustrated embodiment with three waves being fashioned as gripping ledge for the fingers of the hand that seizes the waffle-style cutter. A distance of this cross-stay 20 of 4–6 cm from the front end of the support plate 11 has proven ergonomically meaningful for a sure grasping of the waffle-style cutter.

Figure 4:
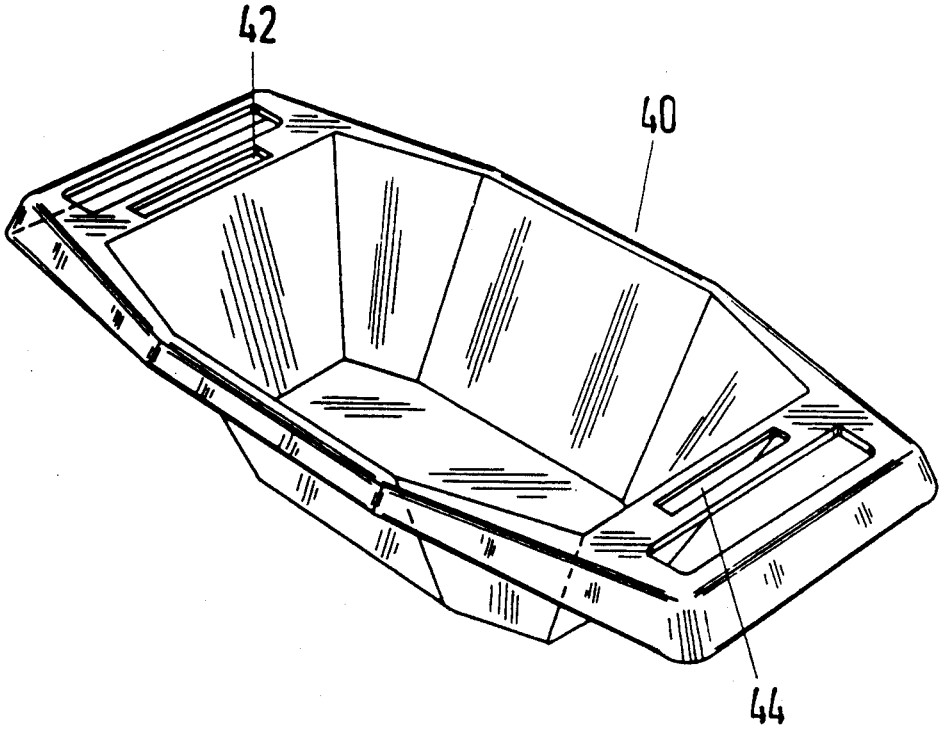
FIG. 4 is of a bowl employable in conjunction with the waffle-style cutter of the invention, shown in a perspective view.

FIG. 4 shows a collecting dish 40 that, as a consequence of the described holding grip design, can be employed especially well together with the slicer of the invention. The collecting dish 40 comprises symmetrically arranged recesses 42 and 44 in its upper edge region. These are optionally conceived for the penetration of the angled profile 22 of the slicer of the invention and are correspondingly dimensioned in order to guarantee an optimally reliable seating of the waffle-style cutter on the collecting dish 40. The penetration of the angled profile 22 through one of the recesses 42 or 44 makes it possible to hold the collecting dish 40 and the waffle-style cutter of the invention together with one hand. By way of addition, let it be mentioned that the collecting dish 40, of course, serves for the acceptance of the material sliced with the waffle-style cutter of the invention.

Both individually as well as in arbitrary combinations, the features of the invention disclosed in the above description, in the drawings as well as in the claims can be essential for the realization of the various embodiments of the invention.

Although the invention has been described with respect to preferred embodiments, it is not to be so limited as changes and modifications can be made which are within the full intended scope of the invention as defined by the appended claims.

I claim as my invention:

1. A waffle-style cutter for slicing foods such as fruits or vegetables comprising a blade-holding plate at whose front edge a wave-shaped cutter blade is arranged, comprising two frame ledges arranged essentially parallel, and comprising a slide plate adjoining the frame ledges and introduceable parallel to the blade-holding plate, whereby a narrow gap remains between the trailing edge of the slide plate and the cutter blade, characterized in that a support plate (11) fashioned as a closed surface is arranged under the slide plate (6).

2. A waffle-style cutter according to claim 1, characterized in that the support plate (11) comprises essentially the same shape as the slide plate (6).

3. A waffle-style cutter according to claim 1, characterized in that the support plate (11) comprises recesses (15) for the penetration of noses (**6*e*–6*h*) arranged at appropriate locations of the underside of the slide plate (6**) in a first latched position thereof.

4. A waffle-style cutter according to claim 3, characterized in that the noses at the underside of the slide plate (6) are supported on the support plate (11) in a second latched position of said slide plate.

5. A waffle-style cutter according to claim 1, characterized in that the support plate (11) comprises an unlocking opening (16) for the slide plate (6).

6. A waffle-style cutter according to claim 1, characterized in that a cross-stay (20) residing perpendicularly on the underside of the support plate (11) is arranged at the underside of said support plate and extends from one frame side to the other.

7. A waffle-style cutter according to claim 6, characterized in that the cross-stay (20) is fashioned wave-shaped with three or four waves and is arranged at a distance of 4–6 cm from the leading end (22) of the waffle-style cutter.

8. A waffle-style cutter according to claim 1, characterized in that the leading end (22) of the waffle-style cutter is fashioned as an angled profile.

9. An elongated waffle-style cutter for slicing foods such as fruits or vegetables comprising:

A. a blade holding member having:

i. a pair of side ledges essentially parallel to each other;

ii. a blade holding plate extending between the ledges and from one end of the cutter toward the other and having a wave-shaped cutter blade arranged at the inner position on the blade holding plate;

iii. support means adjacent the other end of the blade holding plate and extending toward the cutter;

B. a slide plate member positionable in the blade holding plate for support on the support means and extending toward the blade but defining a gap therebetween wherein:

the support means comprises a support plate being of a size and shape similar to the slide plate;

said blade holder plate includes nose means for cooperation in defining a first and second slide plate latching positions;

said slide plate has notch means for cooperation with said nose means in defining first and second slide plate latching positions;

said support plate has a plurality of latching apertures;

said slide plate has a plurality of latch projections for selective insertion into said support plate latching apertures so as to selectively adjust the positioning of the slide plate relative to the support plate; and said support plate includes removal aperture means extending therethrough through said slide support plate whereby said slide plate can be accessed for unlatching.

* * * * *